US005117736A

United States Patent [19]

Mäder

[11] Patent Number: 5,117,736

[45] Date of Patent: Jun. 2, 1992

[54] AUTOMATIC WEAPON CARTRIDGE FEED DEVICE

[75] Inventor: Helmut Mäder, Schramberg, Fed. Rep. of Germany

[73] Assignee: Mauser Werke Oberndorf GmbH, Oderndorf, Fed. Rep. of Germany

[21] Appl. No.: 634,787

[22] Filed: Dec. 27, 1990

Related U.S. Application Data

[63] Continuation of Ser. No. 450,625, Dec. 14, 1989, abandoned.

[30] Foreign Application Priority Data

Dec. 23, 1988 [DE] Fed. Rep. of Germany ... 8815966[U]

[51] Int. Cl.[5] ..... F41A 9/02; F41A 9/30

[52] U.S. Cl. ..... 89/33.25; 89/33.17

[58] Field of Search ..... 89/33.16, 33.17, 33.25, 89/157

[56] References Cited

U.S. PATENT DOCUMENTS

| | | | |
|---|---|---|---|
| 1,290,852 | 1/1919 | Sturgeon | 89/33.16 |
| 2,766,663 | 10/1956 | Dixon | 89/33.25 |
| 4,223,589 | 9/1980 | Post | 89/33.25 |
| 4,765,223 | 8/1988 | Beckmann | 89/33.16 |

FOREIGN PATENT DOCUMENTS

| | | | |
|---|---|---|---|
| 475915 | 5/1929 | Fed. Rep. of Germany | 89/33.25 |
| 3342222 | 11/1985 | Fed. Rep. of Germany | 89/33.16 |
| 3703437 | 7/1988 | Fed. Rep. of Germany . | |
| 19641 | of 1907 | United Kingdom | 89/33.25 |

*Primary Examiner*—Stephen Johnson
*Attorney, Agent, or Firm*—McGlew & Tuttle

[57] ABSTRACT

A cartridge feed device of an automatic weapon, including a damping coil spring 5 arranged in a hollow shaft 13 carrying a star wheel 14. The initial torsional tension of the coil spring 5 may be set and adjusted. A coupling sleeve 10 is arranged for this purpose between a follower sleeve 7 and the hollow shaft 13. In its disengaged position, the follower sleeve 7 is adjustable relative to the other follower sleeve 2 of the coil spring 5 relative to the axis of rotation D. In the engaged position, the coupling sleeve 10 holds the follower sleeve 7 nonrotatably relative to the hollow shaft 13.

12 Claims, 3 Drawing Sheets

AUTOMATIC WEAPON CARTRIDGE FEED DEVICE

This is a file wrapper continuation application of application Ser. No. 07/450,625 filed Dec. 14, 1989 now abandoned.

FIELD AND BACKGROUND OF THE INVENTION

The present invention pertains to a cartridge feed device of an automatic weapon comprising at least one star wheel that can be rotated for cartridge transport stepwise around an axis of rotation on a hollow shaft. A coil spring is arranged coaxially, with one end of the hollow shaft with the coil spring connected nonrotatably around the axis of rotation by means of a follower sleeve to the hollow shaft. The other end of the coil spring is connected nonrotatably around the axis of rotation to a gas pressure-operated drive member by means of another follower sleeve. Such a device was described in West German Patent Specification No. 33,42,222. The drive member is driven by the gas pressure of the weapon. This causes the coil spring to rotate around the axis of rotation. It also carries the star wheel via the hollow shaft. The coil spring allows the gas pressure to develop suddenly without leading to an excessively strong, jerky rotation of the star wheel. The movement of the star wheel is damped by the coil spring.

In West German Patent Specification No. 33,42,222, no possibility is provided for adjusting the initial torsional tension of the coil spring. There are fluctuations in the torque with which the coil spring drives the star wheel. These fluctuations can also be attributed to frictional forces acting on the coil spring, which are difficult to control.

A device of the type specified in the introduction was also described in West German Patent Specification No. 37,03,437. Means for setting and adjusting the initial torsional tension of the coil spring are not provided by this reference either. This has an unfavorable effect on cartridge transport.

SUMMARY AND OBJECT OF THE INVENTION

It is an object of the invention to propose a cartridge feed device of the class specified in the introduction, in which the initial torsional tension of the coil spring can be set and adjusted.

This task is achieved according to the present invention with a cartridge feed device of the type specified in the introduction by providing a coupling sleeve between the follower sleeve and the hollow shaft or the drive member; that the angle of rotation of the follower sleeve relative to the other follower sleeve is adjustable relative to the axis of rotation in the disengaged position of the coupling sleeve; and that in the coupling position, the coupling sleeve nonrotatably holds the follower sleeve relative to the hollow shaft or the driving member in the angular position set.

In this device, the initial torsional tension of the coil spring can be set, adjusted, and readjusted at any time. This is made possible by the fact that the coupling sleeve is brought into its disengaged position, after which the follower sleeves are rotated against each other. The coupling sleeve is subsequently returned into its engaged position in this angular position, as a result of which the initial tension set for the coil spring is determined. Correct setting of the initial tension of the coil spring guarantees safe transport of the cartridges and of the cartridge belt by means of the star wheels.

It is achieved, in particular, that the coil spring does not lie against the hollow shaft on the inside and the windings of the coil spring and do not touch each other, so that frictional forces, which would hinder the cartridge transport, do not occur between the coil spring and the hollow shaft or between the windings of the coil spring. Consequently, strong pressing forces can be achieved for the cartridge transport with relatively weak forces of the gas pressure-driven pressing member, and the initial tension of the coil spring being adjusted if needed.

In a preferred embodiment of the present invention, the angular position of the follower sleeve can be finely adjusted relative to the hollow shaft. It is thus achieved that the relative angular position between the follower sleeve driven by the drive member and the end of the coil spring which is rigidly attached to the follower sleeve does not need to be changed and that not only is a force-locking connection provided between the hollow shaft and the follower sleeve driving same, but the angular positions of the follower sleeve can also be rather finely adjusted relative to the hollow shaft.

In a preferred embodiment of the present invention, the coupling sleeve has a ring gear on the outside, which meshes with the internal teeth of the hollow shaft, and the coupling sleeve is provided on the inside with a ring gear which meshes with the external teeth of the follower sleeve. As a result, in its engaged position, the coupling sleeve establishes a positive locking connection between follower sleeve and said hollow shaft.

To bring said coupling sleeve into the disengaged position, it is displaced axially relative to the follower sleeve and the hollow shaft. This offers the advantage that neither the coil spring nor the follower sleeve engaged with it, nor the hollow shaft need to be displaced axially relative to one another to adjust the initial torsional tension of the coil spring.

In a further improved variant of the present invention, one of the ring gears of the coupling sleeve is longer in the axial direction than the other, so that in the disengaged position of the coupling sleeve, the longer ring gear meshes with the teeth associated with it, whereas the shorter ring gear is disengaged from the teeth associated with it. This makes it easier to bring the coupling sleeve into the engaged position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
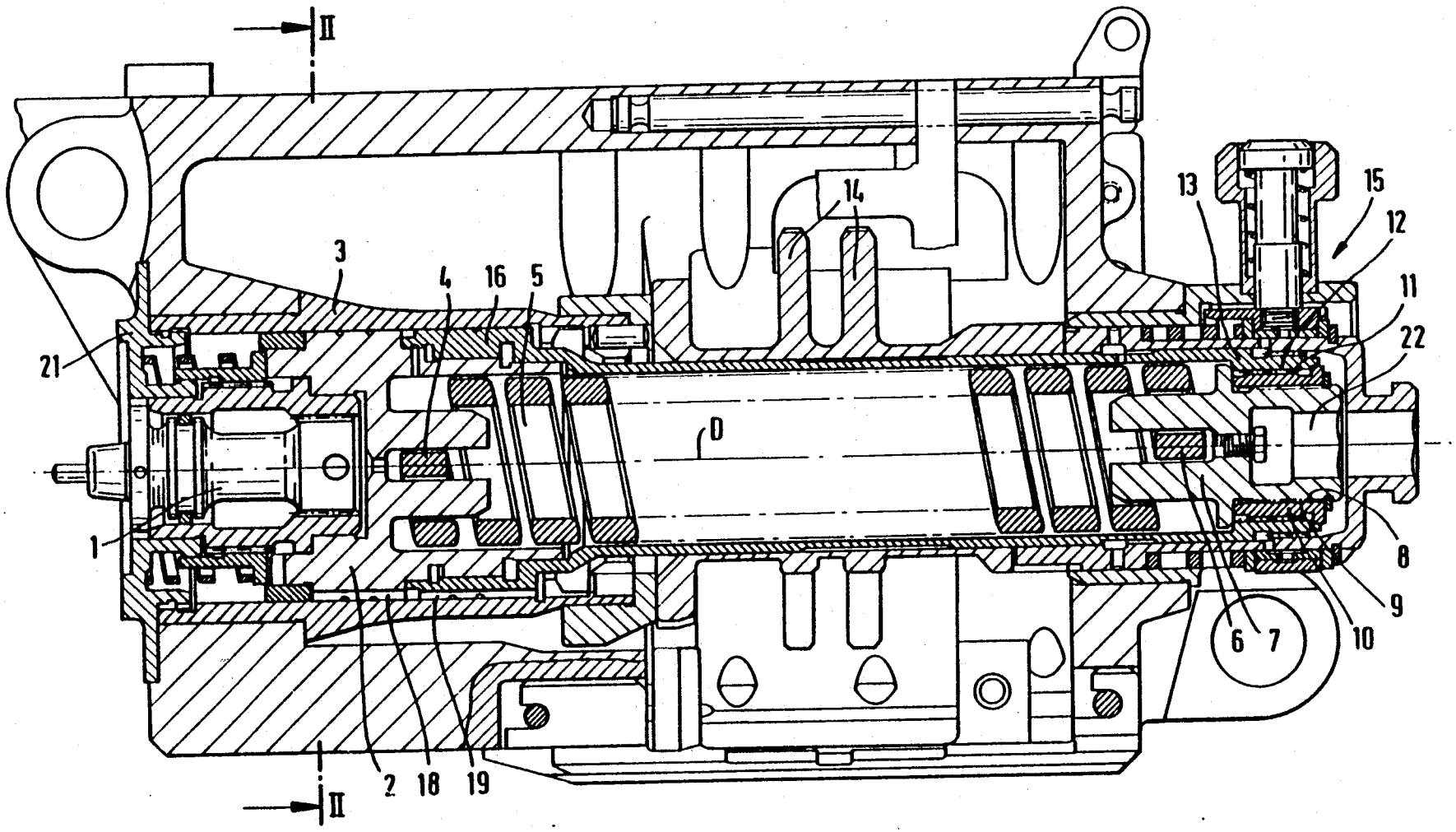
FIG. 1 is a longitudinal sectional of a cartridge feed device.

A cartridge feed device of an automatic weapon has a gas pressure-operated driving piston that is not shown in detail. The piston is connected by a drive shaft 1 to a first follower sleeve 2 such that the follower first sleeve 2 rotates by one step around the axis of rotation D on admission of gas pressure to the driving piston from the barrel of the weapon (not shown).

The first follower sleeve 2 is mounted rotatably around axis D in housing part 3. One end 4 of a coil spring 5 is held on the follower sleeve 2 nonrotatably.

The other end 6 of the coil spring 5 is arranged in a second follower sleeve 7. The two ends 4 6 of the coil spring 5 are axially displaceable in the follower sleeves 2, 7, so that initial torsional tensions of the coil spring (5) do not lead to axial stressing of the follower sleeves 2, 7, and the windings of the coil spring 5 are not in contact with one another.

The second follower sleeve 7 has external teeth 8, with which an internal ring gear 9 of a coupling sleeve 10 meshes. The coupling sleeve 10 is provided on the outside with an external ring gear 11, which meshes with internal teeth 12 of a hollow shaft 13. Star wheels 14 for transporting cartridges (not shown more specifically) or a cartridge belt are mounted nonrotatably on the hollow shaft 13, and this nonrotatable connection is provided between the hollow shaft 13 and the star wheels 14 via a coupling device 15.

Figure 2:
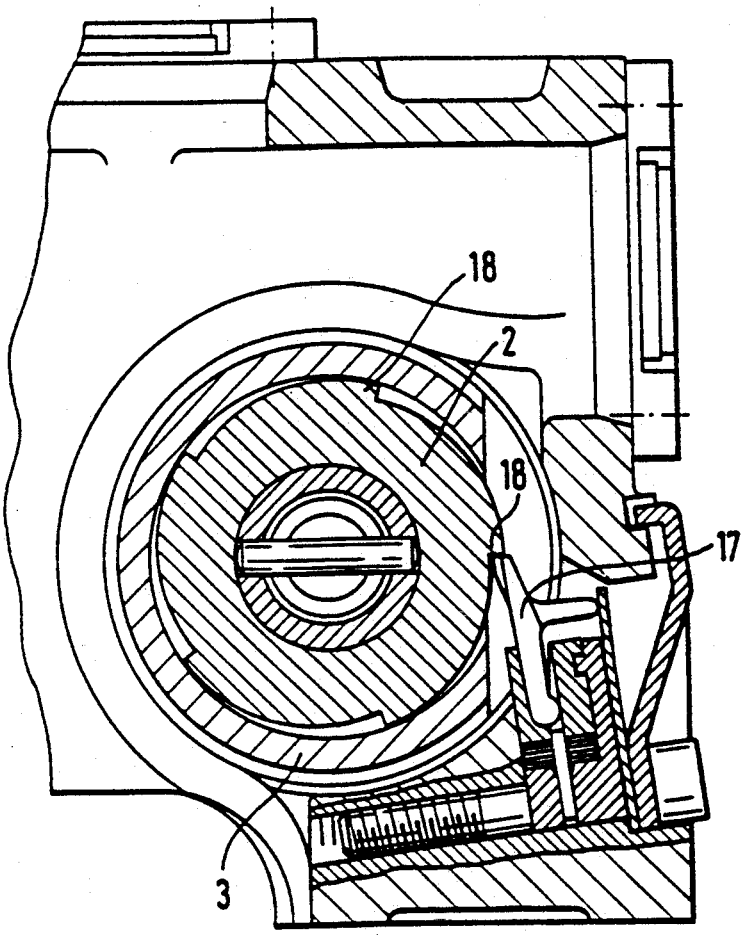
FIG. 2 is a sectional view taken along line II—II according to FIG. 1; and, FIG. 3 is a perspective view of a coupling sleeve.

The hollow shaft 13 is rotatable on the first follower sleeve 2 with its end 16 opposite the end with its internal teeth 12, and it is also mounted rotatably in the housing part 3. A catch tongue 17 (see FIG. 2), which is associated with detents 18 of the first follower sleeve 2, is arranged on the housing part 3. Five detents 18 are provided on the circumference of the follower sleeve 2. Consequently, the detents 18 are staggered by 72° relative to one another. Identical detents 19 are also provided at the end 16 of said hollow shaft 13. These are also caught by the catch tongue 17.

Figure 3:
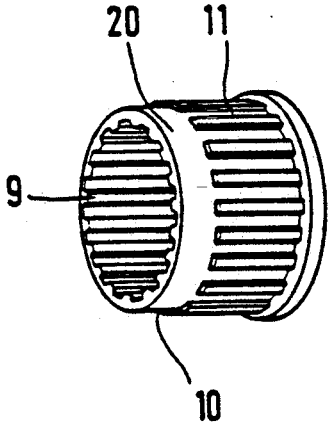
Figure 4:
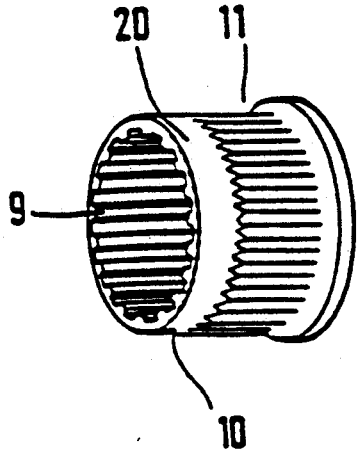
FIG. 4 is a perspective view of a coupling sleeve with the shorter ring gear having a finer pitch than the longer ring gear.

The teeth of the internal ring gear 9 of the coupling sleeve 10 are longer in terms of the axial length of the axis of rotation D than the teeth of the external ring gear 11 of the coupling sleeve 10. The coupling sleeve 10 correspondingly has a guide surface 20 (see FIG. 3). However, it is also possible to make the teeth of the internal ring gear 9 shorter in the axial direction of the axis of rotation D than the teeth of the ring gear 11. The guide surface is obtained in this case on the inner circumference of the coupling sleeve 10.

The pitch of both ring gears 9, 11 may be the same. However, the ring gear having the shorter teeth, which can be disengaged in the manner described more specifically below, preferably has a finer pitch than the ring gear that cannot be disengaged.

The device described operates substantially as follows:

Before a shot is fired from the barrel of the weapon, which is not shown more specifically, the catch tongue 17 holds the hollow shaft 13 locked via the detents 18, 19.

On firing, the first follower sleeve 2 is suddenly rotated around the axis of rotation D by the gas pressure associated with the firing. It also rotates the coil spring 5, as a result of which the second follower sleeve 7 follows the rotary movement in a damped manner under the action of the coil spring 5. The coil spring 5 is not in contact with the inside of the hollow shaft 13, and the windings of the coil spring 5 do not touch each other, so that the transmission of force between the first follower sleeve 2 and the second follower sleeve 7 is not influenced by frictional forces that vary in an uncertain manner. The movement of the second follower sleeve 7 is damped by the coil spring 5 relative to the first follower sleeve 2. The hollow shaft 13 is carried without slip, relative to the second follower sleeve 7 because it is in a positive-locking connection with the external ring gear 11 of the coupling sleeve 10 via its internal teeth 12 and with the external teeth 8 of the follower sleeve 7 via its internal ring gear 9. Consequently, the star wheels 14 are tripped via the coupling device 15, as a result of which the cartridge or belt (not shown more specifically) is transported further by one step. After this step, the end 16 of the hollow shaft 13 is locked with its next detent 19 on the catch tongue 17.

To adjust the initial torsional tension of the coil spring 5 to the actual conditions in terms of the force exerted by the driving piston or the drive shaft 1 to the transport force necessary for driving the star wheels 14, the initial tension of the coil spring 5 can be adjusted in a simple manner. To do so, a cover plate 21 of the housing part 3 is removed, and the assembly unit consisting especially of the follower first sleeve 2, the hollow shaft 13, the follower second sleeve 7, said the coil spring 5, and the coupling sleeve 10 is removed together with it from the housing part 3 (to the left according to FIG. 1). The star wheels 14 are not removed.

The coupling sleeve 10 is subsequently moved in the axial direction, so that its external ring gear 11 will separate from the internal teeth 12 of the hollow shaft 13. The second follower sleeve 7 is subsequently rotated with a hexagonal recess 22 relative to the follower sleeve 2 such that the coil spring 5 will have the desired initial tension. The coupling sleeve 10 is subsequently engaged, so that the nonrotatable connection between the follower sleeve 7 and the hollow shaft 13 is ensured. In this position, which is subsequently adjusted, the assembly unit is pushed back into the housing part 3, after which engagement with the star wheels 14 is accomplished.

While specific embodiments of the invention have been shown and described in detail to illustrate the application of the principles of the invention, it will be understood that the invention may be embodied otherwise without departing from such principles.

What is claimed is:

1. Cartridge feed device comprising:

a hollow shaft rotatable about a hollow shaft axis;

a star wheel having a first connection to said hollow shaft;

a coil spring having a first and second end, and arranged substantially coaxially with said hollow shaft;

a first follower sleeve having a second connection to said first end of said coil spring;

a drive member having a third connection to said first follower sleeve;

a second follower sleeve having a fourth connection to said second end of said coil spring; and, coupling bushing means movable between an engaged state, connecting said second follower sleeve and said hollow shaft, and a disengaged state, disconnecting said second follower sleeve and said hollow shaft for tension adjustment of said coil spring.

2. A cartridge feed device in accordance with claim 1, wherein:

said coupling bushing means in said engaged state is positioned in one of a plurality of angular positions relative to one of said drive member and said star wheel, and is movable in said disengaged state to another one of said plurality of angular positions.

3. A cartridge feed arrangement according to claim 2, wherein the angular position of said second follower sleeve is finely adjustable relative to said hollow shaft via an angular movement of said coupling bushing means.

4. Cartridge feed device comprising:

a hollow shaft rotatable about a hollow shaft axis, having internal teeth;

a star wheel having a first connection to said hollow shaft;

a coil spring having a first and second end, and arranged substantially coaxially with said hollow shaft;

a first follower sleeve having a second connection to said first end of said coil spring;

a drive member having a third connection to said first follower sleeve;

a second follower sleeve having a fourth connection to said second end of said coil spring; and, a coupling bushing means movable between an engaged state, connecting said second follower sleeve and said hollow shaft, and a disengaged state, disconnecting said second follower sleeve and said hollow shaft for tension adjustment of said coil spring, said coupling bushing means having a coupling sleeve, with an outer ring gear which meshes with said internal teeth of said hollow shaft.

5. A cartridge feed arrangement according to claim 4, wherein said coupling sleeve includes an inner surface with a ring gear and said second follower has external teeth, one of said outer surface ring gear and said inner surface ring gear being longer in an axial direction than the other, thereby allowing said longer ring gear to be engaged while said shorter ring gear is disengaged.

6. A cartridge feed arrangement according to claim 5, wherein said outer ring gear has teeth that are shorter in an axial direction than said inner ring gear.

7. A cartridge feed arrangement according to claim 5, wherein said coupling sleeve is guided on a guide surface when disengaged.

8. A cartridge arrangement according to claim 5, wherein said shorter ring gear has a finer pitch than said longer ring gear.

9. Cartridge feed device comprising:

a hollow shaft rotatable about a hollow shaft axis;

a star wheel having a first connection to said hollow shaft;

a coil spring having a first and second end, and arranged substantially coaxially with said hollow shaft;

a first follower sleeve having a second connection to said first end of said coil spring;

a drive member having a third connection to said first follower sleeve;

a second follower sleeve having a fourth connection to said second end of said coil spring, said second follower having external teeth; and, a coupling bushing means movable between an engaged state, connecting said second follower sleeve and said hollow shaft, and a disengaged state, disconnecting said second follower sleeve and said hollow shaft for tension adjustment of said coil spring, said coupling bushing means having a coupling sleeve, with an inner ring gear which meshes with said external teeth of said second follower sleeve.

10. A cartridge feed device according to claim 9, wherein said second follower sleeve includes a recess for adjusting said second follower sleeve relative to said coupling sleeve.

11. A cartridge feed arrangement according to claim 9, further comprising a housing part containing a locking mechanism associated with said first follower sleeve, for locking said first follower sleeve in a locked position relative to said housing part.

12. A cartridge feed arrangement according to claim 11, wherein said locking mechanism additionally locks the hollow shaft to said housing part.

* * * * *